US006618880B1

(12) United States Patent
Chase

(10) Patent No.: US 6,618,880 B1
(45) Date of Patent: Sep. 16, 2003

(54) MATTRESS COVER WITH EXPANDABLE SIDEWALLS

(75) Inventor: Samuel Chase, Succasunna, NJ (US)

(73) Assignee: Fabrictech 2000 LLC, Newark, NJ (US)

( * ) Notice: Subject to any disclaimer, the term of this patent is extended or adjusted under 35 U.S.C. 154(b) by 0 days.

(21) Appl. No.: 10/183,305

(22) Filed: Jun. 27, 2002

(51) Int. Cl.[7] ..... A47G 9/02
(52) U.S. Cl. ..... 5/500; 5/699; 5/484; 5/738
(58) Field of Search ..... 5/699, 737, 738, 5/484, 499, 500, 501

(56) References Cited

U.S. PATENT DOCUMENTS

| | | | | | |
|---|---|---|---|---|---|
| 2,639,444 | A | * | 5/1953 | Monsabert | 5/699 |
| 2,879,524 | A | | 3/1959 | Eisen | 5/354 |
| 3,436,771 | A | | 4/1969 | Fisher | 5/334 |
| 4,809,375 | A | | 3/1989 | Bull | 5/465 |
| 4,935,287 | A | * | 6/1990 | Johnson et al. | 428/198 |
| 4,962,546 | A | * | 10/1990 | Vitale | 5/497 |
| 5,007,123 | A | | 4/1991 | Salyards | 5/448 |
| 5,090,074 | A | * | 2/1992 | Scales et al. | 5/699 |
| 5,127,115 | A | | 7/1992 | Williams et al. | 5/497 |
| 5,321,861 | A | * | 6/1994 | Dancey et al. | 5/482 |
| 5,636,393 | A | | 6/1997 | Zafiroglu et al. | 5/499 |
| 5,693,412 | A | * | 12/1997 | Walters | 428/317.1 |
| 5,883,028 | A | * | 3/1999 | Morman et al. | 442/394 |
| 5,910,081 | A | * | 6/1999 | Graham | 5/699 |
| 5,966,759 | A | * | 10/1999 | Sanders et al. | 5/499 |
| 6,088,859 | A | | 7/2000 | Cavazos | 5/739 |
| 6,096,668 | A | * | 8/2000 | Abuto et al. | 442/328 |
| 6,174,584 | B1 | | 1/2001 | Keller et al. | 428/102 |
| 6,272,701 | B1 | | 8/2001 | Zafiroglu | 5/499 |
| 6,381,778 | B1 | | 5/2002 | Peterson | 5/497 |

* cited by examiner

*Primary Examiner*—Michael F. Trettel
(74) *Attorney, Agent, or Firm*—Wolff & Samson PC

(57) ABSTRACT

A generally impermeable mattress cover having expandable sidewalls is provided to enclose a mattress to provide protection against allergens, dust mites, fluids, and other spills and spoils. The cover comprises generally impermeable top and bottom walls, and sidewalls connected at edges between the top and bottom walls. The sidewalls are formed of a double wall construction comprising a generally impermeable inner wall of a fixed height joined at edges to an elastic outer wall. The outer wall stretches and the inner wall extends to accommodate mattresses of different thicknesses. The outer wall can be relaxed and the inner wall retained neatly against the mattress and by the outer wall. An aperture can be provided in the bottom wall for allowing insertion and removal of a mattress and a fastener can be used to close the aperture.

12 Claims, 2 Drawing Sheets

MATTRESS COVER WITH EXPANDABLE SIDEWALLS

BACKGROUND OF THE INVENTION

1. Field of the Invention

The present invention relates generally to covers for mattresses, and more specifically, to a generally impermeable mattress cover with expandable sidewalls to fit mattresses of different thicknesses.

2. Related Art

Allergens and other irritants such as spores and dust mites can freely exist in mattresses, and can be the cause of allergic reactions to certain individuals. As such, it is often desirable to cover a mattress to protect same from allergens, dust mites, fluids, and other spoils. It is also desirable to protect mattresses from spills and other fluids, such as urine and blood. In locations where mattresses are frequently used, such covers are beneficial in preserving the life of the mattress and providing added comfort for users. Even at home, one can use such a cover to protect a mattress and extend its life. Indeed, by using a mattress cover to keep a mattress free of stains, one can assure that they comply with the warranty provided by the mattress manufacturers which are voided when mattresses are stained.

It is known in the art to provide covers for mattresses to protect same from the aforementioned fluids and allergens existing in the mattress. However, there do not exist any covers with expandable sidewalls that completely cover a mattress and allow the cover to be used on mattresses of different thicknesses. Rather, such covers must be made in numerous sizes or must be custom-manufactured to fit beds and/or mattresses of different thicknesses.

Accordingly, what is desirable, but has not heretofore been provided, is a generally impermeable mattress cover that completely surrounds a mattress and has expandable sidewalls to accommodate mattresses of different thicknesses.

SUMMARY OF THE INVENTION

The present invention relates to a generally impermeable mattress cover that completely surrounds a mattress and has expandable sidewalls to accommodate mattresses of different thicknesses. The cover includes generally impermeable top and bottom walls that are attached at edges thereof to sidewalls. The sidewalls include inner and outer walls that are joined at edges thereof. The inner walls are generally impermeable and have a fixed height, and the outer walls are made of an elastic material. The inner walls have a height greater than the elastic outer wall when the outer wall is in a relaxed condition. When positioned on a mattress, the outer wall retains the inner wall against the mattress. The elastic outer walls can stretch to a height equal to the height of the inner wall to accommodate the thickness of the mattress. Importantly, the sidewalls, in conjunction with the top and bottom walls, provide a generally impermeable shield that completely surrounds the mattress, while accommodating mattresses of different thicknesses. The bottom wall includes an aperture for allowing insertion and removal of the mattress from the cover, and a fastener for opening and closing the aperture.

The present invention can be fabricated in a simple manufacturing process, wherein the top and bottom walls are cut to desired dimensions, the sidewalls are fabricated from an inner impervious wall and a stretchable outer wall that are joined at top and bottom edges, and the sidewalls are joined to edges of the top and bottom walls to form an expandable cover having an impervious shield that completely surrounds a mattress.

BRIEF DESCRIPTION OF THE DRAWINGS

These and other important objects and features of the invention will be apparent from the following Detailed Description of the Invention taken in connection with the accompanying drawings in which.

DETAILED DESCRIPTION OF THE INVENTION

The present invention relates to a generally impermeable mattress cover having expandable sidewalls to accommodate mattresses of different thicknesses. The cover of the present invention can be used on any type of mattress. By the terms "generally impermeable" or "impermeable" it is meant that the material is waterproof or water resistant, as well as resistant to other fluids and resistant to solids such as allergens and dust mites. The cover of the present invention comprises a generally impermeable top wall, a generally impermeable bottom wall, and sidewalls attached to the top and bottom walls. The sidewalls comprise a generally impermeable inner wall and an elastic outer wall joined at edges thereof to the top and bottom walls. The inner wall has a height greater than the outer wall when the outer wall is in a relaxed condition. The outer wall can be stretched to the height of the inner wall. The outer wall retains the inner wall neatly against the mattress to provide a uniform fit.

Figure 1:
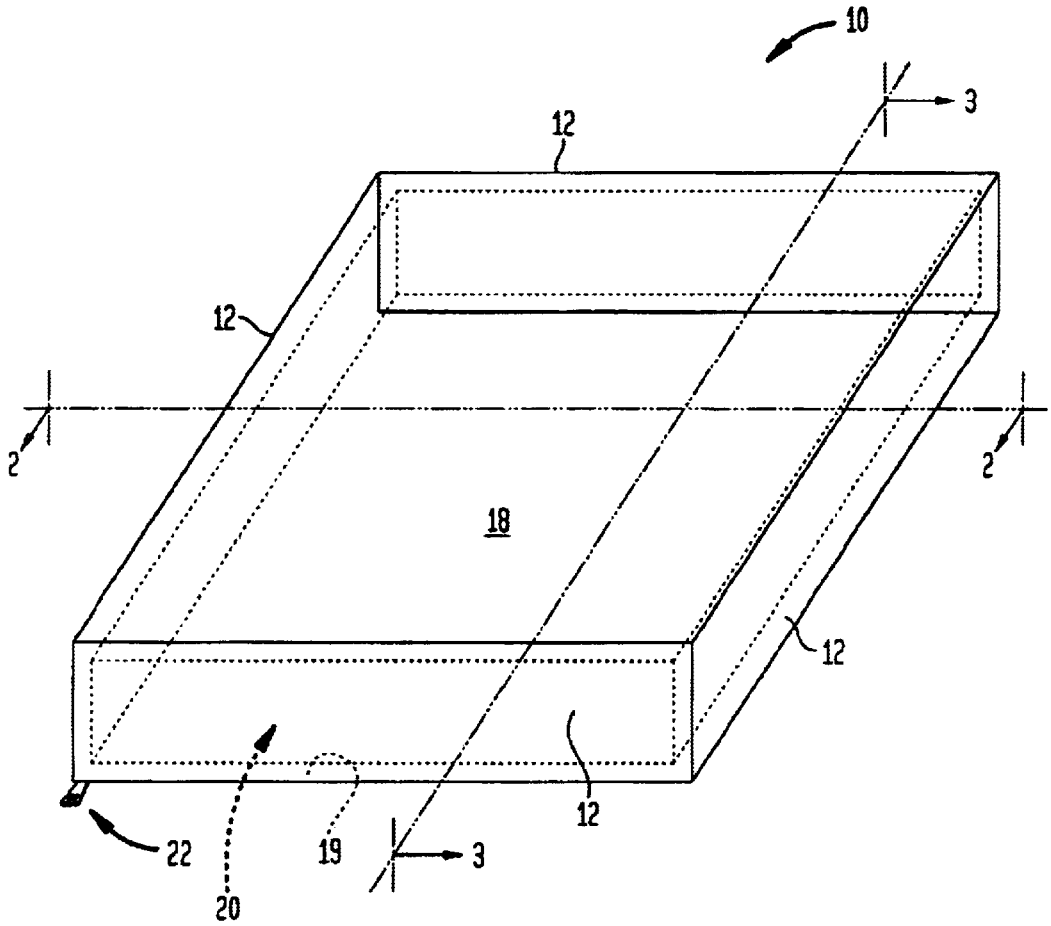
FIG. 1 is a perspective view of the mattress cover of the present invention positioned on a mattress.

FIG. 1 is a perspective view of the present invention. The cover 10 surrounds a mattress 20 to protect same from allergens, fluids, and other undesired spoils. The cover 10 comprises top wall 18, bottom wall 19 and sidewalls 12.

Importantly, top and bottom walls 18 and 19, and sidewalls 12 of the present invention are made of a generally impermeable material. Sidewalls 12 and 14 are preferably formed from a two-part construction, as will hereinafter be described in greater detail, and are joined at edges thereof to top wall 18 and bottom wall 19 to provide a generally impermeable barrier that completely surrounds mattress 20. Sidewalls 12 and 14 can be joined to top wall 18 and bottom wall 19 using any technique known in the art, such as stitching, ultrasonic welding, gluing, etc.

An aperture is provided on cover 10 to allow insertion and removal of mattress 20 from cover 10. A fastener, such as zipper 22, is used to close the cover. In a preferred embodiment of the present invention, zipper 22 is positioned proximal to a portion of the perimeter of bottom wall 19, and preferably near one end of the cover 10 in a C-shaped configuration. However, it is to be expressly understood that zipper 22 could be positioned at any desired location on cover 10 without departing from the scope of the present invention. It should be noted that zipper 22 is preferably manufactured to maintain a generally impermeable seal to allergens and fluids when closed. Any other fastener means for allowing access to the internal cavity defined by cover 10 and may be utilized with the present invention.

Figure 2:
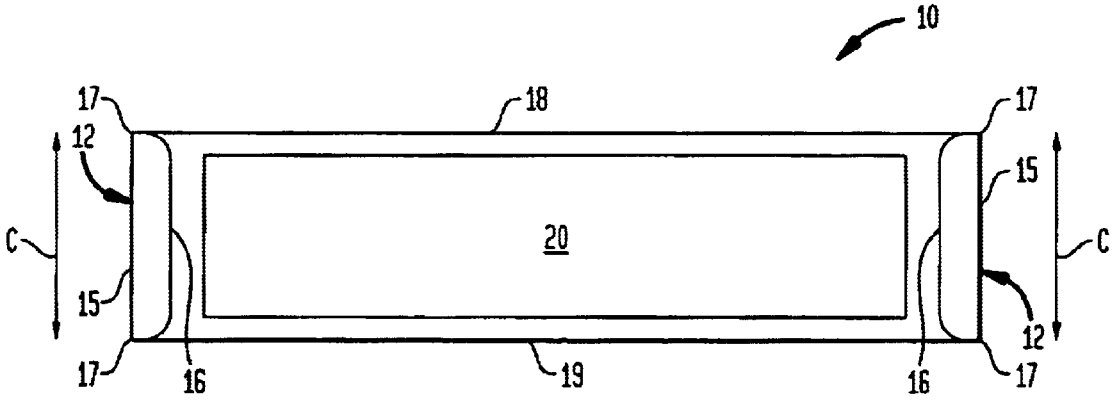
FIG. 2 is a cross-sectional view of the present invention, taken along the line 2—2 of FIG. 1.

FIG. 2 is a cross-sectional view of the present invention, taken along the line 2—2 of FIG. 1. Top wall 18 and bottom wall 19 are joined at edges 17 to sidewalls 12 of cover 10. Sidewalls 12 are formed of a two-part construction comprising outer walls 15 and inner walls 16 that are joined together at edges 17. Inner walls 16 comprise a material that is generally impermeable to allergens and fluids, preferably the same material as top wall 18 and bottom wall 19. The outer wall 15 is made of an elastic material that can be stretched. In a preferred embodiment of the present invention, the outer walls 15 are 12 inches in height in a relaxed position, and capable of being stretched to a height of 20 inches, while the inner walls 16 are 20 inches in height. Other heights, dimensions, and materials for the outer walls 15 and inner walls 16 are considered within the scope of the present invention.

Importantly, sidewalls 12 are expandable in height along the direction indicated generally by arrows C to allow the cover 10 to fit on mattresses of different thicknesses. When the outer walls 15 are stretched, inner walls 16 extend vertically to also accommodate the mattress thickness while providing a generally impermeable enclosure around the mattress.

Figure 3:
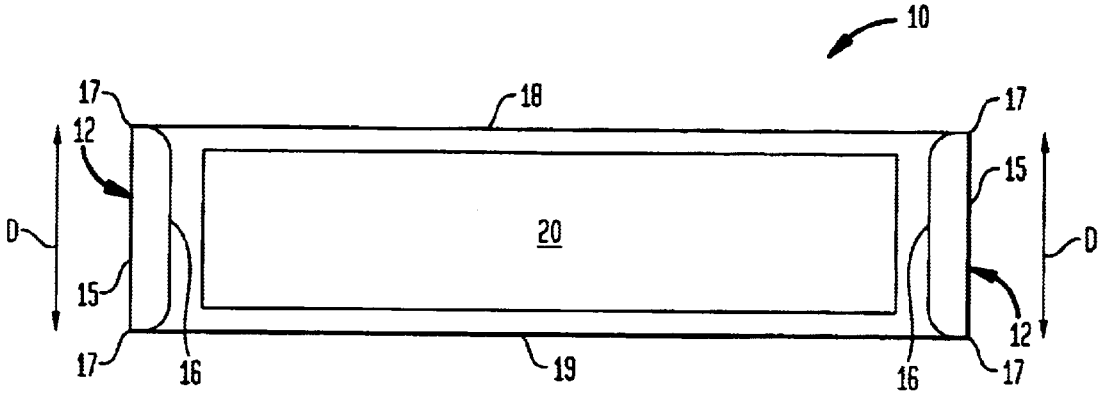
FIG. 3 is a cross-sectional view of the present invention, taken along the line 3—3 of FIG. 1.

FIG. 3 is a cross-sectional view of the present invention, taken along the line 3—3 of FIG. 1, showing the mattress and cover lengthwise. As shown in FIG. 3, sidewalls 12 are attached to top wall 18 and bottom wall 19 at edges 17, in the same manner as described with respect to FIG. 2. The sidewalls 12 are expandable along the direction generally indicated by arrows D, accommodating mattress 20 and allowing mattresses of different thicknesses to be covered by cover 10.

Figure 4:
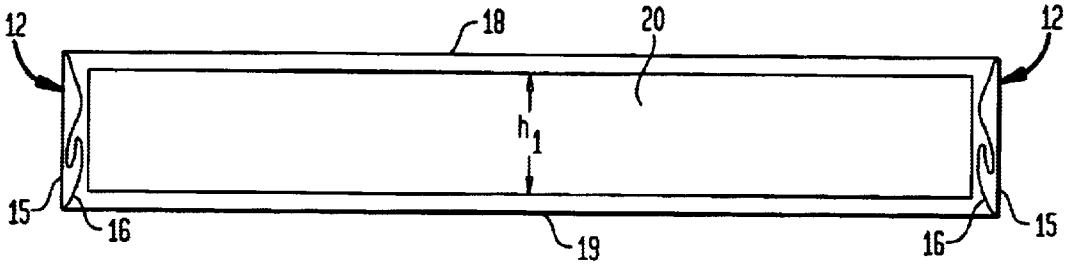
FIG. 4 is a cross-sectional view of the present invention, showing the inner walls folded and snugly positioned to accommodate a mattress of a first thickness.

FIG. 4 is a cross-sectional view of the present invention, showing the inner walls 16 and outer walls 15 positioned about a mattress of a first height $h_1$. Height $h_1$ is purely illustrative in nature, but for purposes of describing the present invention, $h_1$ could be approximately 12 inches, or the minimum height of sidewalls 12 when outer walls 15 are in a relaxed position. Of course, any height can be substituted for $h_1$ without departing from the scope of the present invention. The outer walls 15 retain the generally impermeable inner walls 16 are neatly against the mattress 20. The inner walls 16 provide a generally impermeable layer that protects the mattress 20.

Figure 5:
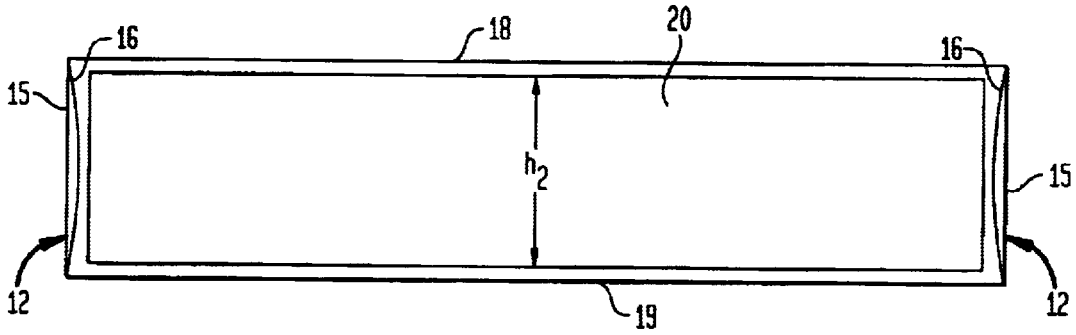
FIG. 5 is a cross-sectional view of the present invention, showing the outer walls stretched and the inner walls extended to accommodate a mattress of a larger thickness.

FIG. 5 is a cross-sectional view of the present invention, showing the outer walls 15 stretched and the inner walls 16 extended to accommodate a mattress 20 having a larger height $h_2$. For purposes of illustration, $h_2$ is approximately 20 inches. Additionally, inner walls 16 stretch to the same height as the outer walls 15 (i.e., to approximately the height $h_2$), and maintain a generally impermeable barrier around mattress 20.

Thus, as illustrated in FIGS. 4–5 and described herein, the outer wall 15 of the sidewall 12 can be stretched to accommodate mattresses of different thicknesses. Concurrently, the inner wall 16 of sidewall 12 extends to accommodate such thicknesses while maintaining a generally impermeable barrier around the mattress. Any slack in the inner wall is covered and neatly retained by the elastic outer walls. This arrangement provides the distinct advantage of protecting mattresses from allergens, fluids, dust mites, etc., while allowing mattresses of different dimensions to be neatly covered.

In a preferred embodiment of the present invention, top wall 18, bottom wall 19 and the inner wall 16 of side wall 12 are manufactured from a generally impermeable material, such as PROPORE, a water resistant, breathable polypropylene material manufactured by the Minnesota Mining and Manufacturing Company ("3M"). PROPORE and 3M are registered trademarks of the Minnesota Mining and Manufacturing Company. Of course, any other generally impermeable material known in the art can be utilized to form these walls.

The cover of the present invention can be fabricated in a simple manufacturing process. First, the top and bottom walls of the cover can be cut to desired dimensions from a sheet or roll of generally impermeable material. Then, the inner walls of the sidewalls can be cut to desired height, and the outer walls cut from a sheet or roll of elastic material. Next, the inner walls and outer walls can be joined at edges thereof, such as by stitching, to form the sidewalls of the cover. Finally, the sidewalls can then be attached to the edges of the top and bottom walls by stitching or other process.

Having thus described the invention in detail, it is to be understood that the foregoing description is not intended to limit the spirit and scope thereof. What is desired to be protected by Letters Patent is set forth in the appended claims.

What is claimed is:

1. A generally impermeable mattress cover for completely surrounding a mattress comprising:

generally impermeable top and bottom walls, one of the bottom or top walls having an aperture to position the cover over the mattress;

expandable sidewalls connected between the top and bottom walls, the sidewalls including a generally impermeable inner wall and an elastic outer wall; and a fastener for closing the aperture.

2. The cover of claim 1, wherein the generally impermeable inner wall and the elastic outer wall are joined together at edges thereof.

3. The cover of claim 1, wherein the generally impermeable inner wall has a fixed height.

4. The cover of claim 3, wherein the fixed height is approximately 20 inches.

5. The cover of claim 1, wherein the elastic outer wall has a height of approximately 12 inches when relaxed.

6. The cover of claim 1, wherein the elastic outer wall can be stretched to a height of approximately 20 inches.

7. The cover of claim 1, wherein the elastic outer wall neatly retains the generally impermeable inner wall against the mattress.

8. The cover of claim 1, wherein the fastener comprises a zipper.

9. A sidewall for a mattress cover comprising:

a generally impermeable inner wall; and an elastic outer wall connected at edges to the generally impermeable inner wall, wherein the elastic outer wall can be stretched and the impervious inner wall extended to accommodate mattresses of different thicknesses.

10. The method of claim 9, further comprising providing an aperture and a fastener to close the aperture on either the top or bottom walls.

11. The method of claim 9, wherein the step of joining the top wall, the sidewalls, and the bottom walls comprises sewing.

12. The method of claim 9, wherein the step of joining the inner wall to the outer wall comprises sewing the inner wall to the outer wall at edges thereof.

* * * * *

UNITED STATES PATENT AND TRADEMARK OFFICE

CERTIFICATE OF CORRECTION

PATENT NO. : 6,618,880 B1
DATED : September 16, 2003
INVENTOR(S) : Samuel Chase

It is certified that error appears in the above-identified patent and that said Letters Patent is hereby corrected as shown below:

Column 4,
Lines 50-56, please delete Claim 9 and insert the following:
-- A method of manufacturing a mattress cover comprising:
providing generally impermeable top and bottom walls of desired dimensions;
providing an elastic outer wall and generally impermeable inner wall;
joining the elastic outer wall and the generally impermeable inner wall at edges to form sidewalls; and
joining the sidewalls at edges to the top and bottom walls. --

Signed and Sealed this

Twentieth Day of January, 2004

JON W. DUDAS
*Acting Director of the United States Patent and Trademark Office*